US011075456B1

(12) United States Patent
Hennig et al.

(10) Patent No.: US 11,075,456 B1
(45) Date of Patent: Jul. 27, 2021

(54) PRINTED BOARD ANTENNA SYSTEM

(71) Applicants: Kelly Jill T. Hennig, Torrance, CA (US); John M. Trippett, Torrance, CA (US); Steven J. Mass, La Palma, CA (US); Raymon O. Fuertes, Whittier, CA (US); Randall J. Duprey, Manhattan Beach, CA (US)

(72) Inventors: Kelly Jill T. Hennig, Torrance, CA (US); John M. Trippett, Torrance, CA (US); Steven J. Mass, La Palma, CA (US); Raymon O. Fuertes, Whittier, CA (US); Randall J. Duprey, Manhattan Beach, CA (US)

(73) Assignee: NORTHROP GRUMMAN SYSTEMS CORPORATION, Falls Church, VA (US)

( * ) Notice: Subject to any disclaimer, the term of this patent is extended or adjusted under 35 U.S.C. 154(b) by 625 days.

(21) Appl. No.: 15/693,139

(22) Filed: Aug. 31, 2017

(51) Int. Cl.
*H01Q 1/52* (2006.01)
*H01Q 1/38* (2006.01)
(Continued)

(52) U.S. Cl.
CPC ..... *H01Q 1/526* (2013.01); *H01Q 1/38* (2013.01); *H01Q 1/523* (2013.01); *H01Q 21/0025* (2013.01); *H01Q 21/22* (2013.01)

(58) Field of Classification Search
CPC ..... H01Q 9/0485; H01Q 13/28; H01Q 21/12; H01Q 19/32; H01Q 1/523; H01Q 1/526; H01Q 1/2283; H01Q 21/0025; H05K 2201/09618; H05K 2201/10068; H01L 2224/73253
See application file for complete search history.

(56) References Cited

U.S. PATENT DOCUMENTS 5,400,042 A 3/1995 Tulintseff
8,665,040 B1 3/2014 Chappell et al.
(Continued)

FOREIGN PATENT DOCUMENTS

JP 2014-527474 A 10/2014

OTHER PUBLICATIONS

Church, Additive Manufacturing: The Next Frontier for Research, Business and Opportunity, NSF workshop on Frontiers of Additive manufacturing Research and education, U.S., National Science Foundation, Jul. 12, 2013, pp. 1-27, URL, http://nsfam.mae.ufl.edu/Slides/Church.pdf.
(Continued)

*Primary Examiner* — Ricardo I Magallanes
(74) *Attorney, Agent, or Firm* — Tarolli, Sundheim, Covell & Tummino LLP

(57) ABSTRACT

One example includes an antenna system. The antenna system includes a plurality of printed boards arranged in layers and including a first printed board and a second printed board. The first printed board includes a resonator and the second printed board includes a shield. The antenna system also includes at least one conductive via that extends through each of the plurality of printed boards and is coupled to a transceiver. The at least one conductive via can cooperate with the resonator to at least one of transmit a wireless signal from the transceiver via the antenna system or receive the wireless signal at the transceiver via the antenna system.

22 Claims, 3 Drawing Sheets

(51) Int. Cl.
*H01Q 21/00* (2006.01)
*H01Q 21/22* (2006.01)

(56) References Cited

U.S. PATENT DOCUMENTS

| | | | | |
|---|---|---|---|---|
| 8,736,505 | B2 | 5/2014 | Lambert et al. | |
| 10,256,545 | B2 | 4/2019 | Boryssenko et al. | |
| 10,547,118 | B2 | 1/2020 | Guntupalli et al. | |
| 2003/0137456 | A1 | 7/2003 | Sreenivas et al. | |
| 2005/0285808 | A1 | 12/2005 | Holter | |
| 2006/0232479 | A1 | 10/2006 | Walton | |
| 2008/0030416 | A1 | 2/2008 | Lee et al. | |
| 2008/0111757 | A1 | 5/2008 | Bisiules et al. | |
| 2009/0091406 | A1* | 4/2009 | Kushta | H05K 1/0222 333/260 |
| 2010/0117903 | A1 | 5/2010 | Zheng | |
| 2010/0194629 | A1 | 8/2010 | Craig et al. | |
| 2011/0059688 | A1 | 3/2011 | Noonan et al. | |
| 2013/0038495 | A1 | 2/2013 | Benzel et al. | |
| 2013/0214980 | A1 | 8/2013 | Lambert et al. | |
| 2014/0218251 | A1 | 8/2014 | Waschenko et al. | |
| 2015/0162663 | A1 | 6/2015 | Boryssenko et al. | |
| 2015/0162665 | A1 | 6/2015 | Boryssenko et al. | |
| 2016/0211585 | A1* | 7/2016 | Chau | H01Q 21/062 |
| 2018/0159203 | A1* | 6/2018 | Baks | H01Q 9/0407 |
| 2019/0013592 | A1 | 1/2019 | West et al. | |
| 2019/0020114 | A1* | 1/2019 | Paulotto | H01Q 1/521 |
| 2019/0260137 | A1 | 8/2019 | Watanabe et al. | |
| 2019/0279950 | A1* | 9/2019 | Kim | H01L 23/5389 |
| 2019/0319369 | A1 | 10/2019 | Chiang et al. | |
| 2020/0106158 | A1 | 4/2020 | Gomez Angulo et al. | |
| 2020/0106178 | A1 | 4/2020 | Chou | |
| 2020/0112081 | A1* | 4/2020 | Kim | H01Q 21/0006 |
| 2020/0185826 | A1 | 6/2020 | Park et al. | |

OTHER PUBLICATIONS

Japanese Office Action corresponding to Japanese Application No. 2018-510348 dated Feb. 26, 2019.

European Examination Report corresponding to European Application No. 16754100.2 dated Feb. 27, 2019.

Entesari Kam Ran et al: 11 Tunab le SIW Structures: Antennas, VCOs, and Filters, IEEE Microwave Magazine, Ieeeservice Center, Piscataway, NJ, US, vol. 16, No. 5, Jun. 1, 2015 (Jun. 1, 2015),pp. 34-54, XP011530297, ISSN: 1527-3342, DOI: 10.1109/MMM.2015.2408273 [retrieved on May 6, 2015] * p. 49,; figure 10 *.

European Search Report for Application No. 20157215.3-1205 dated Jun. 29, 2020.

Non Final Office Action for U.S. Appl. No. 16/352,489 dated Jul. 7, 2020.

International Search Report for Application No. PCT/US2020/059573 dated Feb. 22, 2021.

* cited by examiner

PRINTED BOARD ANTENNA SYSTEM

This invention was made with Government support under Contract No. 15-C-3133. The Government has certain rights in this invention.

TECHNICAL FIELD

The present disclosure relates generally to communications systems, and specifically to a printed board antenna system.

BACKGROUND

All RF wireless communications systems use antennas to radiate RF energy to transmit wireless signals or to capture radiated radio frequency (RF) energy to receive wireless signals. Antennas can be implemented in a variety of forms to transmit and/or receive wireless signals. Some antennas are arranged in an array called a phased-array antenna to provide directional control to transmitted wireless signals or to determine a direction from which a wireless signal was transmitted. A phased-array antenna typically implements electronically scanning the array of antennas, such that the array of antennas creates a beam of radio waves that can be electronically steered to point in different directions, without moving the antennas. For example, the RIP current from the transmitter is fed to the individual antennas with a predetermined phase relationship so that the radio waves from the separate antennas add together to increase the radiation in a desired direction, while cancelling to suppress radiation in undesired directions.

SUMMARY

One example includes an antenna system. The antenna system includes a plurality of printed boards arranged in layers and including a first printed board and a second printed board. The first printed board includes a resonator and the second printed board includes a shield. The antenna system also includes at least one conductive via that extends through each of the plurality of printed boards and is coupled to a transceiver. The at least one conductive via can cooperate with the resonator to at least one of transmit a wireless signal from the transceiver via the antenna system or receive the wireless signal at the transceiver via the antenna system.

Another example includes an antenna system. The antenna system includes a plurality of printed boards arranged in layers and including a first printed board and a second printed board. The first printed board includes a resonator and the second printed board includes a shield. The antenna system also includes at least one conductive via that extends through each of the plurality of printed boards and is coupled to a transceiver. Each of the at least one conductive via can be configured as an inner conductor and the resonator can be configured as an outer conductor to form a coaxial resonator with respect to a wireless signal that is transmitted from the transceiver via the antenna system and/or received at the transceiver via the antenna system. Each of the at least one conductive via includes a first end that is exposed from the first printed board and a second end that is coupled to the transceiver. The first end and the second end can be axially offset from each other between the first end and the second end.

Another example includes a phased-array communication system. The phased-array communication system includes a transceiver configured to at least one of transmit and receive a wireless communication signal. The phased-array communication system also includes an antenna. The antenna includes a plurality of printed boards arranged in layers and including a first printed board and a second printed board. The first printed board includes a plurality of conductive parallel resonator plates. The second printed board includes a shield. The antenna also includes a plurality of conductive vias that each extend through each of the plurality of printed boards and are coupled to the transceiver. Each of the plurality of conductive vias can cooperate with the plurality of conductive parallel resonator plates to at least one of transmit a wireless signal from the transceiver via the antenna system or receive the wireless signal at the transceiver via the antenna in a phased-array.

DETAILED DESCRIPTION

The present disclosure relates generally to communications systems, and specifically to a printed board antenna system. The printed board antenna system can be implemented in a wireless communications system that includes a transceiver to transmit and/or receive wireless communications signals. As described herein, the term "printed board" describes any of a variety of types of printed boards that can be patterned with conductive materials and insulating materials in layers and/or axial extensions, such as a printed circuit board (PCB) or a printed wiring board (PWB). The printed board antenna system includes a plurality of printed boards that are arranged in layers, and are thus stacked with respect to each other.

As an example, the layers of printed boards can include three layers. A first of the three printed boards can include a plurality of conductive resonator plates arranged in parallel layers. The conductive resonator plates can be arranged on an outermost of the printed boards. A second printed board can include a shield that can be grounded to provide shielding for the radiated wireless signal. The printed boards can also include a third printed board that is coupled to the transceiver, and can also include a shield (e.g., that can also be grounded). The antenna system can further include at least one conductive via that extends through each of the printed boards. The conductive via(s) can form an inner conductor, and the conductive resonator plates can form an outer conductor, such that each of the conductive via(s) and the conductive resonator plates can form coaxial resonators for the antenna system with respect to the wireless signals. Additionally, each of the conductive via(s) includes a first end that is exposed from the first printed board, and thus terminates as a resonator end, and a second end that is coupled to the transceiver, with the first and the second ends being axially offset from each other between the first and second ends. As a result, radiation and/or particles do not have a direct line of sight to the sensitive electronics of the transceiver between the inner and outer conductors of the coaxial resonator, which thus mitigates radiation damage to the sensitive electronics of the transceiver.

Figure 1:
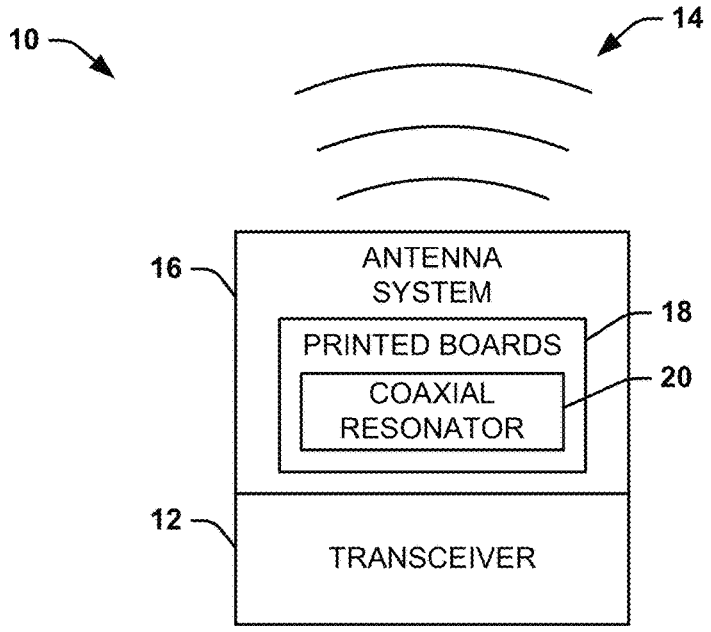
FIG. 1 illustrates an example diagram of a communication system.

FIG. 1 illustrates an example diagram of a communication system 10. The communication system 10 can be implemented for a variety of wireless communications applications, such as for phased-array antenna communications. The communication system 10 includes a transceiver 12 that is configured to transmit and/or receive wireless communications signals, demonstrated in the example of FIG. 1 at 14. As described herein, the term "transceiver" is intended to refer to any of a transmitter that can transmit wireless communications signals, a receiver that can receive wireless communications signals, or a transceiver that can both transmit and receive wireless communications signals.

The transceiver 12 is communicatively coupled to an antenna system 16 that is configured to radiate the transmitted and/or received wireless communications signals 14. The antenna system 16 includes a plurality of printed boards 18 that are arranged in layers, and are thus stacked with respect to each other. As an example, the printed boards 18 can include a first printed board arranged as an outermost of the printed boards 18 that includes a resonator. The resonator can be arranged as any of a plurality of different types of resonator structures, such as a "bow-tie" resonator structure, a resonator structure that is additively manufactured (e.g., three-dimensionally printed) onto the substrate of the first printed board, a plurality of conductive resonator plates arranged in parallel layers, or a variety of other types of resonator structures. The conductive resonator plates can form an outer conductor relative to a conductive via to form a coaxial resonator 20. As an example, the conductive via can extend through each of the printed boards 18, with a first end that is exposed at the first of the printed boards 18 and a second end that is communicatively coupled to the transceiver 12. The printed boards 18 can also include at least one additional printed board layer that includes a shield, such as a conductive shield shorted to ground. Therefore, the printed boards 18 can provide suitable components to form an antenna for transmitting and/or receiving the wireless communications signals 14 to be transmitted from or received at the transceiver 12.

Figure 2:
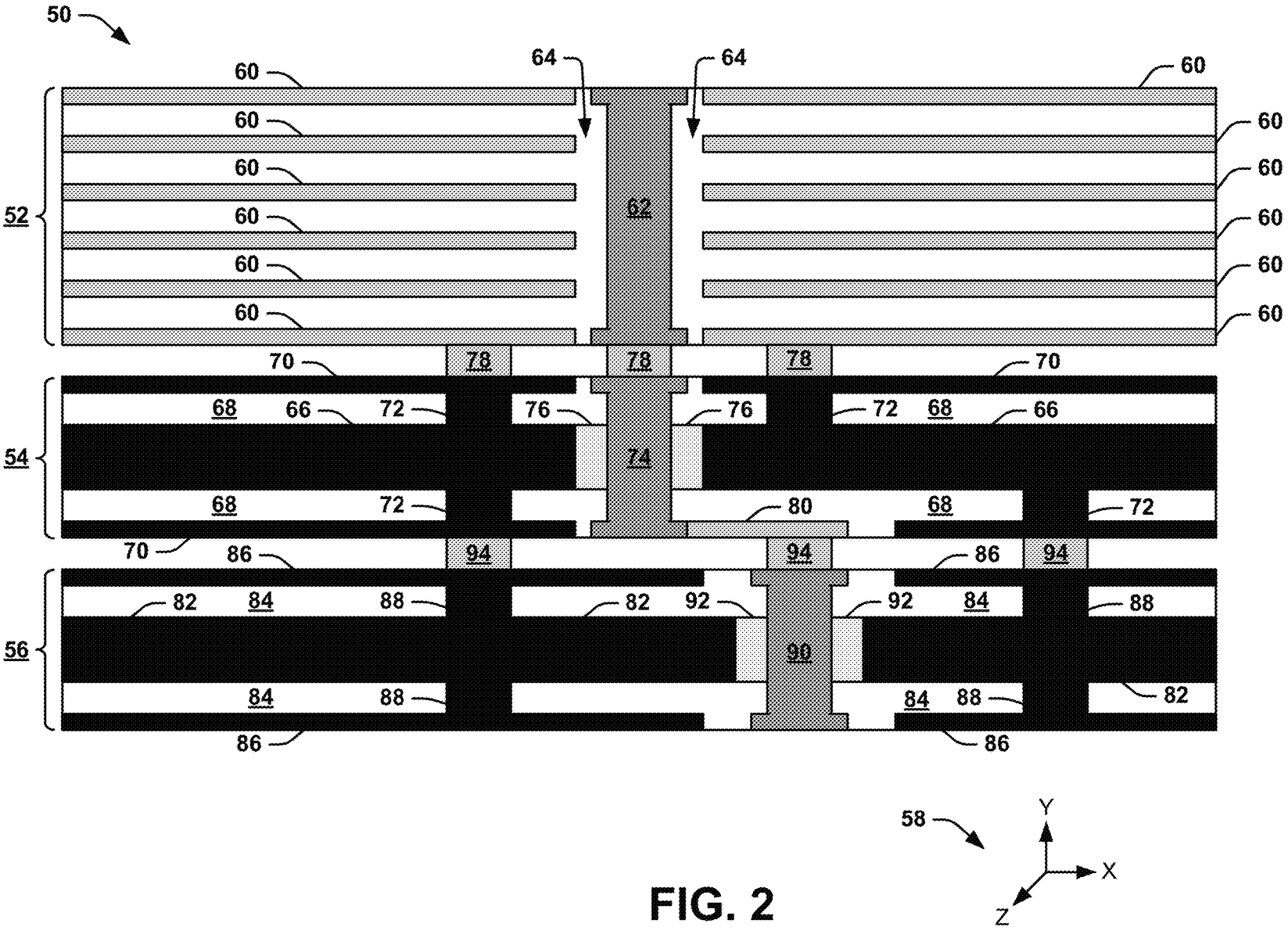
FIG. 2 illustrates an example of a printed board antenna system.

FIG. 2 illustrates an example of a printed board antenna system 50. In the example of FIG. 2, the printed board antenna system 50 is demonstrated in a cross-sectional view. The printed board antenna system 50 can correspond to at least a portion of the antenna system 16 in the example of FIG. 1. Thus, the printed board antenna system 50 can thus be coupled to the transceiver 12 to radiate a transmitted or received wireless RF signal. Therefore, reference is to be made to the example of FIG. 1 in the following description of the example of FIG. 2.

The printed board antenna system 50 includes a first printed board 52, a second printed board 54, and a third printed board 56 that are arranged in layers with respect to each other. Each of the printed boards 52, 54, and 56 extend in respective X-Z planes along a Y-axis, as provided by a Cartesian coordinate system 58. The first printed board 52 includes a plurality of conductive plates 60 that are arranged in parallel planar layers with respect to each other. As an example, the conductive plates 60 can be formed from any of a variety of conductive materials that are suitable for use as an antenna resonator, such as copper, aluminum, or other conductive materials. Thus, each of the conductive plates 60 likewise extend in respective X-Z planes along the Y-axis. The conductive plates 60 can be spaced apart from each other by a predetermined distance along the Y-axis based on desired parameters of the printed board antenna system 50. While the first printed board 52 demonstrates the resonator being configured as the conductive plates 60 arranged in parallel layers, it is to be understood that the first printed board 52 can be configured as having any of a variety of other types of resonator structures, such as a "bow-tie" resonator, an additively manufactured resonator structure, or any of a variety of other types of resonator structures.

The first printed board 52 also includes a first conductive axial extension 62 that is a portion of a conductive via that extends through the first printed board 52, and thus through an aperture of each of the conductive plates 60. As an example, the conductive plates 60 can each have a hole through which the first conductive axial extension 62 extends, such that the first conductive axial extension 62 is surrounded by a given one of the conductive plates 60 in a given X-Z plane. Therefore, the conductive plates 60 can correspond to an outer conductor or a coaxial resonator (e.g., the coaxial resonator 20 in the example of FIG. 1), and the first conductive axial extension 62 can correspond to an inner conductor of the coaxial resonator. In the example of FIG. 2, the first conductive axial extension 62 can be separated from conductive plates 60 by a gap 64. As an example, the gap 64 can be unfilled (e.g., open to atmosphere), or can be filled with a non-conductive dielectric material.

The second printed board 54 includes a first shield 66. The first shield 66 can be configured as a relatively thick or multiple thin planar layers within the second printed board 54, such as extending in a respective X-Z plane. As an example, the first shield 66 can be a conductive shield, such as formed of copper, and can be arranged as a portion of the second printed board 54, such as being arranged between dielectric material layers, demonstrated in the example of FIG. 2 at 68. As another example, the first shield 66 can be configured as a non-conductive shield or conductive and non-conductive shield, such as based on including a plurality of alternating layers of high and low impedance materials (e.g., alternating conductive and/or non-conductive layers). In the example of FIG. 2, the first shield 66 is demonstrated as being coupled to exterior conductor layers 70 through one or more vias 72. As an example, the first shield 66 can be grounded, and can have a predetermined thickness or multiple thin layers with predetermined thicknesses that can correspond to a desired shielding for the wireless communication signal 14.

The second printed board 54 also includes a second conductive axial extension 74 that is a portion of the conductive via that extends through the second printed board 54, and thus through an aperture of the first shield 66. As an example, the first shield 66 can have a hole through which the second conductive axial extension 74 extends, such that the second conductive axial extension 74 is surrounded by the first shield 66 in the X-Z plane, and separated from the first shield 66 by an insulating material 76. In the example of FIG. 2, the second printed board 54 is coupled to the first printed board 52 via a plurality of conductive adhesive bonds 78. In the example of FIG. 2, the conductive adhesive bonds 78 couple the exterior conductor layers 70 to at least one of the conductive plates 60, and separately couple the first and second conductive axial extensions 62 and 74. Therefore, the second conductive axial extension 74 is associated with the inner conductor of the coaxial resonator through the second printed board 54. In addition, the second printed board 54 includes a conductive offset portion 80 that is arranged at an exterior portion of the second printed board 54 and is conductively coupled to the second conductive axial extension 74.

The third printed board 56 includes a second shield 82. The second shield 82 can be configured as a relatively thick or multiple thin planar layers within the third printed board 56, such as extending in a respective X-Z plane. As an example, the second shield 82 can be a conductive shield, such as formed of copper, and can be arranged as a portion of the third printed board 56, such as being arranged between dielectric material layers, demonstrated in the example of FIG. 2 at 84. As another example, the second shield 82 can be configured as a non-conductive shield or conductive and non-conductive shield, such as based on including a plurality of alternating layers of high and low impedance materials (e.g., alternating conductive and/or non-conductive layers). In the example of FIG. 2, the second shield 82 is demonstrated as being coupled to an exterior conductor layer 86 through one or more vias 88. As an example, the exterior conductor layer 86 can be unitary, or can be composed of multiple discrete parts that are formed on an exterior of the third printed board 56. As an example, the second shield 82 can be grounded, and can have a predetermined thickness or multiple thin layers with predetermined thicknesses that can correspond to a desired shielding for the wireless communication signal 14.

The third printed board 56 also includes a third conductive axial extension 90 that is a portion of the conductive via that extends through the third printed board 56, and thus through an aperture of the second shield 82. As an example, the second shield 82 can have a hole through which the third conductive axial extension 90 extends, such that the third conductive axial extension 90 is surrounded by the second shield 82 in the X-Z plane, and separated from the second shield 82 by an insulating material 92. In the example of FIG. 2, the third printed board 56 is coupled to the second printed board 54 via a plurality of conductive adhesive bonds 94. In the example of FIG. 2, the conductive adhesive bonds 94 couple the exterior conductor layers 86 to at least one of the exterior conductor layers 70 of the second printed board 54, and separately couple the third conductive axial extension 90 to the conductive offset portion 80.

The first, second, and third conductive axial extensions 62, 74, and 90, along with the respective conductive adhesive bonds 78 and 94 and the conductive offset portion 80, therefore collectively form the conductive via through the printed board antenna system 50 that corresponds to the inner conductor of the coaxial resonator. The first conductive axial extension 62 thus includes a first end of the conductive via that is exposed to atmosphere, and thus forms an end of the antenna, and the third conductive axial extension 90 includes a second end of the conductive via that can be coupled to the transceiver 12, such as via a conductive bond (e.g., solder, etc.) to conduct the wireless communication signal between the printed board antenna system 50 and the transceiver 12.

Based on the conductive offset portion 80, the first end and the second end of the conductive via are axially offset from each other between the first and second ends. In other words, the first and second conductive axial extensions 62 and 74 extend along a first axis, and the third conductive axial extension 90 extends along a second axis that is offset from and parallel with the first axis. As a result, radiation and/or particles associated with received wireless communication signal(s) 14 do not have a direct line of sight to the sensitive electronics of the transceiver 12 in/along the space between the inner conductor (i.e., the conductive via) and the outer conductor (e.g., the conductive plates 60) of the coaxial resonator, which thus mitigates damage to the sensitive electronics of the transceiver 12. As a result of the axial offset of the conductive via, the electronics associated with the transceiver 12 can be located closer to the coaxial resonator that is formed by the conductive via (including the first, second, and third conductive axial extensions 62, 74, and 90; the respective conductive adhesive bonds 78 and 94; and the conductive offset portion 80) as the inner conductor and the conductive plates 60 as the outer conductor.

In addition, the printed board antenna system 50 can be fabricated in a small form-factor, such as for installation on a spacecraft (e.g., a satellite). The shields 66 and 84 can provide suitable radiation shielding to protect the associated electronics (e.g., transceiver), and the small form-factor can be sufficiently compact and lightweight to include on the spacecraft (e.g., at an aperture) while maintaining robust protection from acceleration-induced stresses (e.g., at launch). Additionally, the compact design for the printed board antenna system 50 resulting from the proximal location of the electronics of the transceiver 12 to the coaxial resonator can provide for a more optimal electronic performance of the printed board antenna system 50. Moreover, the design of the printed board antenna system 50 can provide protection for the sensitive electronics of the transceiver 12 without providing a larger, heavy, and expensive aluminum shield around the transceiver 12. Therefore, the printed board antenna system 50 can exhibit a reduction in size, weight, and cost, and can also exhibit greater performance and power efficiency, relative to other antenna systems.

Figure 3:
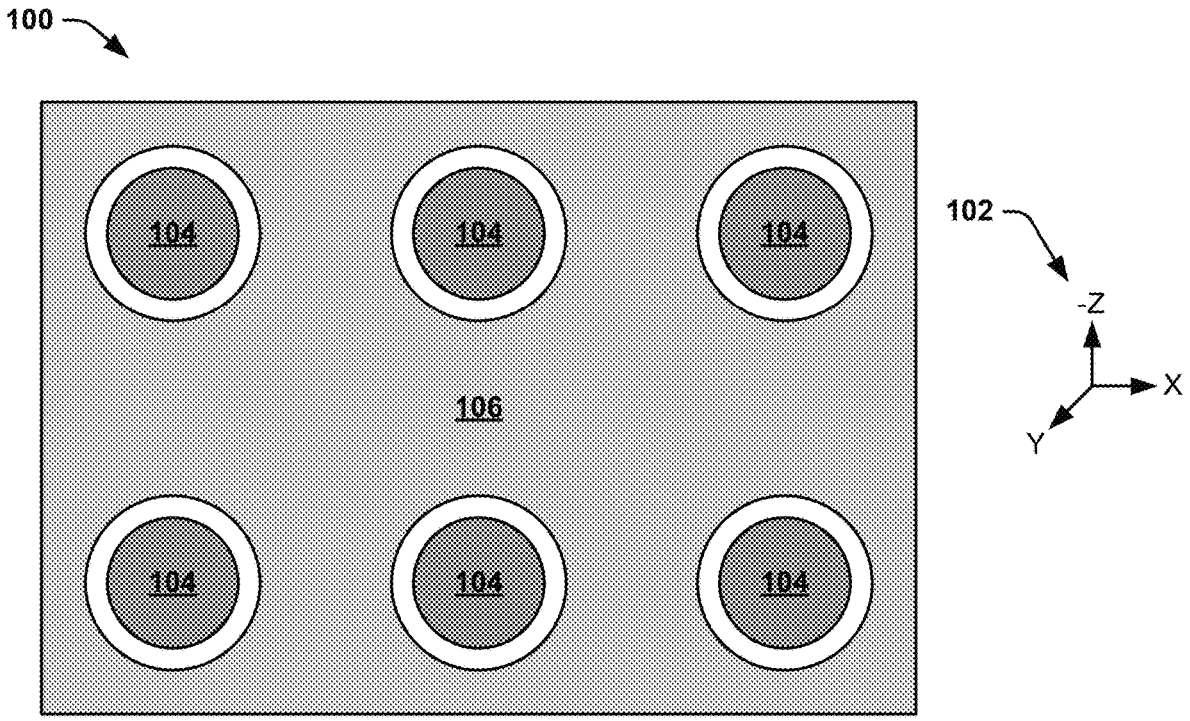
FIG. 3 illustrates an example diagram of a phased-array antenna system.

The printed board antenna system 50 in the example of FIG. 2 is demonstrated as a single printed board antenna system to transmit or receive a wireless communication signal 14. However, the printed board antenna system 50 can be arranged in an array, such as to transmit or receive the wireless communication signal 14 in a phased-array manner. FIG. 3 illustrates an example diagram of a phased-array antenna system 100. The phased-array antenna system 100 can correspond to an array of printed board antenna systems 50. In the example of FIG. 3, the phased-array antenna system 100 is demonstrated in an overhead view relative to the cross-sectional view of the printed board antenna system 50 in the example of FIG. 2. Particularly, the Cartesian coordinate system 102 demonstrates the view of the phased-array antenna system 100 along the Y-axis, as opposed to the X-axis cross-sectional view of the printed board antenna system 50 in the example of FIG. 2.

The phased-array antenna system 100 includes an overhead view of a first printed board (e.g., the first printed board 52), in which respective ends of a plurality of conductive vias 104 are exposed to atmosphere. The exposed ends of the conductive vias 104 can each correspond to the exposed end of the first conductive axial extension 74 in the example of FIG. 2. Additionally, the phased-array antenna system 100 includes a first conductive plate 106 that is likewise exposed to atmosphere, and can correspond to an outermost (e.g., top-most) conductive plate of the plurality of conductive plates 60 arranged in parallel layers. The conductive vias 104 can be separated (e.g., non-conductively coupled) from the first conductive plate 106 and the remaining conductive plates in the parallel layers. Therefore, each of the conductive vias 104 can correspond to inner conductors with respect to the first conductive plate 106 and the remaining conductive plates in the parallel layers that can correspond to the outer conductors of a plurality of coaxial resonators. Therefore, the coaxial resonators can be arranged to provide a phased-array transmission and reception of the wireless communication signals 14. In addition, each of the conductive vias 104 can correspond to the conductive vias formed by the first, second, and third conductive axial extensions 62, 74, and 90; the respective conductive adhesive bonds 78 and 94; and the conductive offset portion 80 in the example of FIG. 2. Therefore, each of the conductive vias 104 can be axially offset, as described previously, to substantially protect the sensitive electronics of the transceiver 12.

Figure 4:
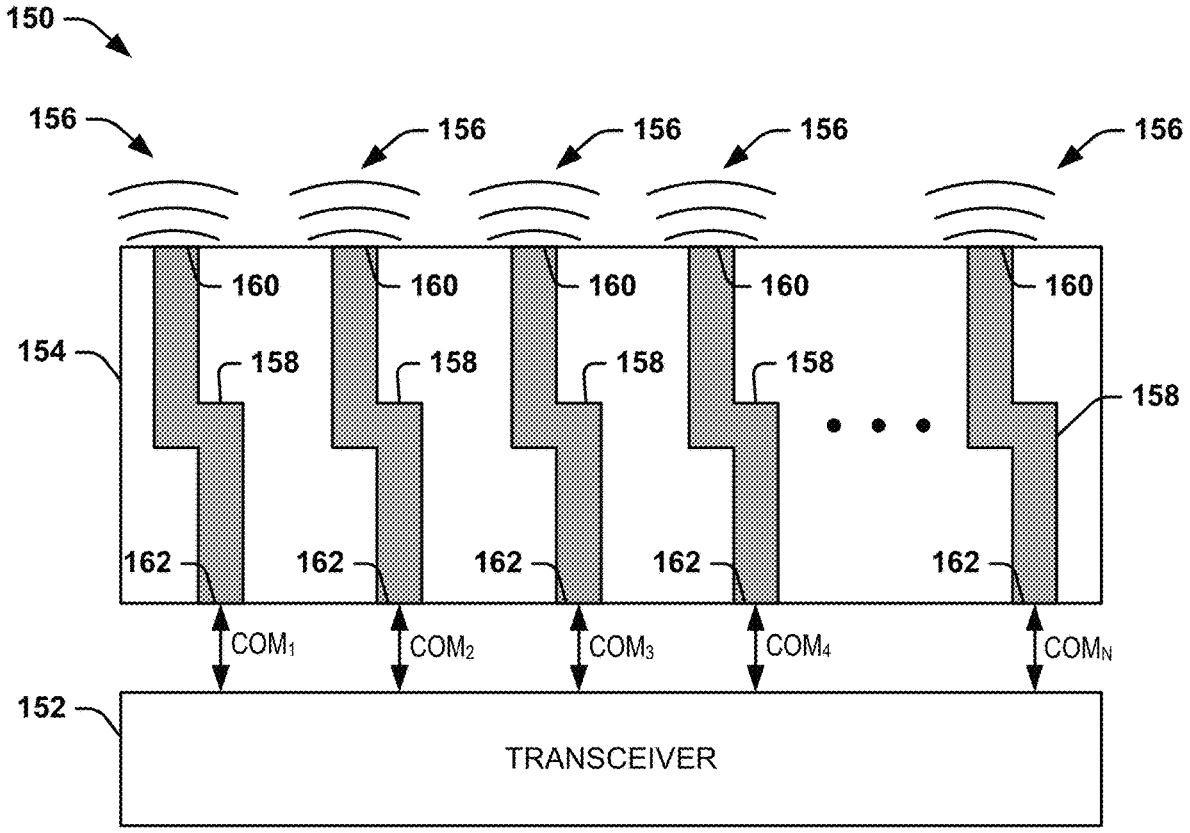
FIG. 4 illustrates an example diagram of a phased-array antenna communication system.

FIG. 4 illustrates an example diagram of a phased-array antenna communication system 150. The phased-array antenna communication system 150 can be implemented for a variety of wireless phased-array communications. The phased-array antenna communication system 150 includes a transceiver 12 that is configured to transmit and/or receive wireless communications signals, demonstrated in the example of FIG. 4 at 152. The transceiver 152 is communicatively coupled to a phased-array antenna system 154 that is configured to radiate the transmitted and/or received wireless communications signals 156. In the example of FIG. 4, the phased-array antenna system 154 is demonstrated simplistically, but it is to be understood that the phased-array antenna system 154 can be configured substantially the same as the phased-array antenna system 100 in the example of FIG. 3 and the printed board antenna system 50 in the example of FIG. 2 (e.g., as a portion of the phased-array antenna system 154). Therefore, the phased-array antenna system 154 can include a plurality of printed boards (e.g., the first printed board 52, the second printed board 54, and the third printed board 56 in the example of FIG. 2).

In the example of FIG. 4, the phased-array antenna system 154 includes a plurality of conductive vias 158 that are arranged as axially offset with respect to respective first ends 160 that are exposed to atmosphere and second ends 162 that are communicatively coupled to the transceiver 152. Therefore, the conductive vias 158 can each correspond to inner conductors with respect to conductive plates (e.g., the conductive plates 60) in one of the printed boards (e.g., the first printed board 52). Therefore, the coaxial resonators can be arranged to provide a phased-array transmission and reception of the wireless communication signals 156. In the example of FIG. 4, the transceiver 152 is configured to at least one of generate or receive substantially identical communications signals COM, demonstrated as $COM_1$ through $COM_N$ corresponding to each of the conductive vias 158 in the array, respectively, that can be phase-shifted relative to each other. For example, the transceiver 152 can be configured to generate the communications signals $COM_1$ through $COM_N$ in a phase-shifted manner. As a result, the communications signals $COM_1$ through $COM_N$ are resonated as the wireless communications signals 156 in a respective phase-shifted manner to steer the wave-front of the wireless communications signals 156. As another example, the wireless communications signals 156 can be received at the phased-array antenna system 154 at the coaxial resonators in a phase-shifted manner. Therefore, the communications signals $COM_1$ through $COM_N$ can be provided to the transceiver 152 in the phase-shifted manner, which can thus be indicative of a direction from which the wireless communications signal 156 was provided to the phased-array antenna system 154. Accordingly, the phased-array antenna communication system 150 can implement the phased-array antenna system 154 in a phased-array communications system.

What have been described above are example embodiments. It is, of course, not possible to describe every conceivable combination of components or methodologies for purposes of describing the example embodiments, but one of ordinary skill in the art will recognize that many further combinations and permutations of the example embodiments are possible. Accordingly, the example embodiments are intended to embrace all such alterations, modifications and variations that fall within the spirit and scope of the appended claims.

What is claimed is:

1. An antenna system comprising:

a plurality of printed boards arranged in layers and comprising a first printed board, a second printed board, and a third printed board, the first printed board comprising a resonator, wherein the resonator is arranged as a plurality of conductive parallel resonator plates that are formed in a stack in the first printed board;

a first set of adhesive bonds to couple the second printed board to the first printed board;

a second set of adhesive bonds to couple the third printed board to the second printed board;

a first conductive via that extends through a respective hole of each of the plurality of conductive parallel resonator plates of the first printed board;

a second conductive via that extends through the second printed board, and is coupled to the first conductive via; and a third conductive via that extends through the third printed board, and is coupled via a conductive offset portion to the second conductive via and is further coupled to a transceiver, each of the first, second, and third conductive vias and the conductive offset portion cooperating with the resonator to at least one of transmit a wireless signal from the transceiver via the antenna system or receive the wireless signal at the transceiver via the antenna system, wherein the plurality of conductive parallel resonator plates are separated via a gap from the first conductive via as the first conductive via extends through the respective hole of each of the plurality of conductive parallel resonator plates of the first printed board, wherein the gap is open to atmosphere to expose respective portions of the plurality of conductive parallel resonator plates to the atmosphere, and wherein the second printed board comprises a shield, dielectric material layers, exterior conductor layers, and the conductive offset portion, the shield being arranged between the dielectric material layers and being coupled through one or more vias to the exterior conductor layers that are arranged at first and second exterior portions of the second printed board, the second conductive via extending through an opening of the shield to contact the conductive offset portion that is arranged at the second exterior portion of the second printed board.

2. The antenna system of claim 1, wherein each of the first, second, and third conductive vias is configured as an inner conductor and the plurality of conductive parallel resonator plates are configured as an outer conductor to form the resonator with respect to the wireless signal.

3. The antenna system of claim 1, wherein the first conductive via comprises a respective end that is exposed from the first printed board and the third conductive via comprises a respective end that is coupled to the transceiver, the respective ends of the first and third conductive vias being axially offset from each other.

4. The antenna system of claim 1, wherein the first and second conductive vias extends axially through one of the first and second printed boards along a first axis and the third conductive via extends axially through the third printed board along a second axis that is not axially aligned with the first axis.

5. The antenna system of claim 4, wherein the conductive offset portion comprises a conductive material layer extending along an outer surface of the second printed board corresponding to the second exterior portion, and the antenna system further comprising a conductive adhesive material to couple the conductive offset portion to the third conductive via.

6. The antenna system of claim 4, wherein the conductive adhesive material is a first conductive adhesive material and the antenna system further comprising a second conductive adhesive material to couple the first conductive via to the second conductive via.

7. The antenna system of claim 6, wherein the shield is a first shield, and the third printed board comprises a second shield extending along the third printed board.

8. The antenna system of claim 1, wherein the first, second, and, third conductive vias are part of a plurality of conductive vias and the conductive offset portion is part of a plurality of conductive offset portions that are each coupled to the transceiver, such that the antenna system is implemented as a phased-array antenna system.

9. A communication system comprising the antenna system of claim 1, the communication system further comprising the transceiver configured to at least one of transmit and receive the wireless signal.

10. An antenna system comprising:

a plurality of printed boards arranged in layers and comprising a first printed board, a second printed board, and a third printed board, the first printed board comprising a resonator, wherein the resonator is arranged as a plurality of conductive parallel resonator plates that are formed in a stack in the first printed board, wherein the second printed is coupled to the first printed board via a first set of adhesive bonds, and the third printed board is coupled to the second printed board via a second set of adhesive bonds;

a first conductive via that extends through a respective hole of each of the plurality of conductive parallel resonator plates of the first printed board, the first conductive via being configured as an inner conductor and the resonator being configured as an outer conductor to form a coaxial resonator with respect to a wireless signal that is at least one of transmitted from a transceiver via the antenna system or received at the transceiver via the antenna system, wherein the plurality of conductive parallel resonator plates are separated via a gap from the first conductive via as the first conductive via extends through the respective hole of each of the plurality of conductive parallel resonator plates of the first printed board, and wherein the gap is open to atmosphere to expose respective portions of the plurality of conductive parallel resonator plates to the atmosphere; and a second conductive via that extends through the second printed board; and a third conductive via that extends through the third printed board, wherein the second conductive via comprises a first end that is coupled via a conductive offset portion to the third conductive via that is coupled to the transceiver and a second end that is coupled to the first conductive via, wherein the first conductive via comprises a first end that is exposed from the first printed board and a second end that is coupled to the second end of the second conductive via to couple the first conductive via to the third conductive via, wherein the first and the second conductive vias are axially offset from each other, and wherein the second printed board comprises a shield, dielectric material layers, exterior conductor layers, and the conductive offset portion, the shield being arranged between the dielectric material layers and being coupled through one or more vias to the exterior conductor layers that are arranged at first and second exterior portions of the second printed board, the second conductive via extending through an opening of the shield to contact the conductive offset portion that is arranged at the second exterior portion of the second printed board.

11. The antenna system of claim 10, wherein the first and second conductive vias extends axially through one of the first and second printed boards along a first axis and the third conductive via extends axially through the third printed board along a second axis that is not axially aligned with the first axis.

12. The antenna system of claim 11, wherein the conductive offset portion comprising a conductive material layer extending along an outer surface of the second printed board corresponding to the second exterior portion, and the antenna system further comprising a conductive adhesive material to couple the conductive offset portion to the third printed board.

13. The antenna system of claim 11, wherein the conductive adhesive material is a first conductive adhesive material and the antenna system further comprising a second conductive adhesive material to couple the first conductive via to the second conductive via.

14. The antenna system of claim 13, wherein the shield is a first shield and the third printed board comprises a second shield extending along the third printed board.

15. A phased-array communication system comprising:

a transceiver configured to at least one of transmit and receive a wireless communication signal; and an antenna comprising:

a plurality of printed boards arranged in layers and comprising a first printed board, a second printed board, and a third printed board, and a plurality of conductive vias, the first printed board comprising a plurality of conductive parallel resonator plates that are formed in a stack in the first printed board;

a first set of adhesive bonds to couple the second printed board to the first printed board; and a second set of adhesive bonds to couple the third printed board to the second printed board, wherein a first subset of conductive vias of the plurality of conductive vias extend through respective holes of each of the plurality of conductive parallel resonator plates of the first printed board, wherein a second subset of conductive vias of the plurality of conductive vias extend through the second printed board and are coupled to respective conductive vias of the first subset of conductive vias, wherein a third subset of conductive vias of the plurality of conductive vias extend through the third printed board and are coupled via respective conductive offset portions to respective conductive vias of the second subset of conductive vias and are further coupled to a transceiver, each of the plurality of conductive vias and the respective conductive offset portions cooperating with the plurality of conductive parallel resonator plates to at least one of transmit the wireless communication signal from the transceiver via the antenna system or receive the wireless communication signal at the transceiver via the antenna system in a phased-array, wherein the plurality of conductive parallel resonator plates are separated via a gap from the first subset of conductive vias as the first subset of conductive vias extend through the respective holes of each of the plurality of conductive parallel resonator plates of the first printed board, wherein the gap is open to atmosphere to expose respective portions of the plurality of conductive parallel resonator plates to the atmosphere, and wherein the second printed board comprises a shield, dielectric material layers, exterior conductor layers, and the conductive offset portion, the shield being arranged between the dielectric material layers and being coupled through one or more vias to the exterior conductor layers that are arranged at first and second exterior portions of the second printed board, the second subset of conductive vias extending through a respective opening of the shield to contact one of the respective conductive offset portions that are arranged at the second exterior portion of the second printed board.

16. The antenna system of claim 15, wherein the first and second subset of conductive vias extends axially through the first printed board along a first axis and the third subset of conductive vias extend axially through the third printed board along a second axis that is not axially aligned.

17. The antenna system of claim 16, wherein the the respective conductive offset portions comprise a conductive material layer extending along an outer surface of the second printed board corresponding to the second exterior portion, and the antenna system further comprising a respective conductive adhesive material to couple one of the respective conductive offset portions to one of the third subset of conductive vias.

18. The antenna system of claim 16, wherein the respective conductive adhesive material is a first respective conductive adhesive material and the antenna system further comprising a second respective conductive adhesive material to couple one of the first subset of conductive vias to one of the second subset of conductive vias.

19. The antenna system of claim 18, wherein the shield is a first shield, and the third printed board comprises a second shield extending along the third printed board.

20. The antenna system of claim 1, wherein the first set of adhesive bonds couple the exterior conductor layers that are arranged at the first exterior portion of the second printed board to one of the plurality of conductive parallel resonator plates of the first printed board.

21. The antenna system of claim 20, wherein the shield is a first shield, the dielectric material layers are a first set of dielectric material layers, and the exterior conductor layers are a first set of exterior conductor layers, and the third printed board comprises a second shield, a second set of dielectric material layers, and a second set of exterior conductor layers, the second shield being arranged between the second set of dielectric material layers and being coupled through one or more vias to the second set of exterior conductor layers that are arranged at first and second exterior portions of the third printed board, the third conductive via extending through an opening of the second shield to contact the conductive offset portion that is arranged at the second exterior portion of the second printed board.

22. The antenna system of claim 21, wherein the second set of adhesive bonds couple the second set of exterior conductor layers that are arranged at the first exterior portion of the third printed board to respective exterior conductors of the first set of exterior conductors that are arranged on the second exterior portion of the second printed board.

* * * * *